US005615415A

United States Patent [19]

Beckerman

[11] Patent Number: 5,615,415

[45] Date of Patent: Apr. 1, 1997

[54] CUSTOM FIT CAP

[75] Inventor: David A. Beckerman, Woodbridge, Conn.

[73] Assignee: Starter Corporation, New Haven, Conn.

[21] Appl. No.: 368,753

[22] Filed: Jan. 4, 1995

Related U.S. Application Data

[63] Continuation of Ser. No. 88,883, Jul. 8, 1993, abandoned.

[51] Int. Cl.[6] ..... A42B 1/22

[52] U.S. Cl. ..... 2/195.3; 2/183; 2/195.2

[58] Field of Search ..... 2/171.1, 171, 175.1, 2/181, 183, 184, 195.1, 195.2, 195.3, 195.7, 195.8, 200.1, 200.2, 418

[56] References Cited

U.S. PATENT DOCUMENTS

| | | | |
|---|---|---|---|
| 1,190,427 | 7/1916 | Kromer | 2/181 |
| 1,995,986 | 3/1935 | Katz | 2/181 |
| 2,052,123 | 8/1936 | Adamson | 2/181 |
| 2,696,618 | 12/1954 | Hoffmat et al. | 2/184 |
| 4,662,007 | 5/1987 | Lipkin | 2/195.1 |
| 5,070,545 | 12/1991 | Tapia | 2/195.1 |
| 5,253,368 | 10/1993 | Blake | 2/195.1 |

FOREIGN PATENT DOCUMENTS

| | | | |
|---|---|---|---|
| 196629 | 12/1938 | Switzerland | 2/195.1 |

*Primary Examiner*—Diana Biefeld
*Attorney, Agent, or Firm*—Jones, Day, Reavis & Pogue

[57] ABSTRACT

A custom-fit cap having a visor portion and a substantially hemispherical crown portion attached to the visor portion and at least a crown portion opposite the visor and covering the back of the head being formed of the material that stretches at least circumferentially about the crown portion for accommodating various head sizes. A band that is stretchable circumferentially and is attached to the inside of the hemispherical crown portion adjacent the base thereof forms a sweat band to engage the head of the user while allowing the cap to stretch circumferentially with at least that portion of the crown portion covering the back of the head opposite the visor, so as to enable the cap to self-adjust automatically to fit a plurality of head sizes.

28 Claims, 2 Drawing Sheets

CUSTOM FIT CAP

This is a continuation, of application Ser. No. 08/088, 883, filed Jul. 8, 1993 and now abandoned, entitled CUSTOM FIT CAP.

BACKGROUND OF THE INVENTION

1. Field of the Invention

The present invention relates generally to visor caps. In particular, it relates to a visored cap having a crown portion formed of a plurality of substantially triangular panels attached to each other to form the hemispherical crown portion and having at least those triangular panels covering the back of the head opposite the visor formed of a material that stretches at least circumferentially about the crown portion for accommodating various head sizes.

2. Discussion of Related Art

Visored caps are of many types and are well known in the art. They include a visor portion and a generally hemispherical crown portion attached to the visor portion for covering the head of the user. The crown portion is usually formed of a plurality of substantially triangular panels, generally six in number, that are joined together with seams to form a substantially hemispherical crown portion. The crown portion is then attached to the visor portion.

There is generally an opening in the base of the hemispherical crown portion at the back of the cap opposite the visor. This opening generally has overlapping straps that are adjustable with respect to each other to change the size of the cap to accommodate a plurality of the different head sizes. The overlapping straps are generally formed of plastic with one of the straps having a plurality of orifices therein and the other of the straps having a corresponding plurality of projections that can be press fit into the orifices of the opposite strap to adjust the size of the hat as needed.

There are disadvantages to the manufacture and use of such cap. In the first place, while the base of the hemispherical portion may be enlarged to accommodate the larger sized head, there must be an aperture formed in the rear of the cap which the overlapping straps span so that the entire hat can expand to some degree to fit the larger head. Thus the rear portion of the cap is not uniform in construction and the forming of the opening or vent creates not only a loss of material but greater difficulty in forming the material.

For fitted caps, a plurality of sizes must be kept in stock thereby requiring not only a large inventory to accommodate all sizes but also a rigorous inventory control system to keep track of the number of the various sizes on hand and which sizes to reorder.

SUMMARY OF THE INVENTION

The present invention overcomes the disadvantages of the prior art by providing a custom-fit cap having no vent and no adjustable straps at the back thereof and yet which can accommodate a plurality of various sized heads. Advantageously, the cap requires, at the most, two sizes to be in stock—small-medium and large-extra large. Further, the perceived quality of a custom fit cap versus those that have adjustable sizes adds a great deal of value to the cap. Thus the number of shelf-kept-units, inventory, is substantially reduced and the perceived quality of the caps is greatly improved.

With the present invention, a substantially hemispherical crown portion has a base and is attached at the base to a visor portion. The hemispherical crown portion covers the head of the user. At least that portion of the hat covering the back of the head opposite the visor is formed of a material that stretches at least circumferentially about the crown portion for accommodating various head sizes.

In addition, a band stretchable circumferentially is attached to the inside of the hemispherical crown portion adjacent the base thereof. The stretchable band forms a sweat band to engage the head of the user and also allows the cap to stretch circumferentially with at least that part of the hat covering the back of the head so as to enable the cap to self-adjust automatically to fit a plurality of head sizes.

Also, the band that is stretchable only circumferentially and that attached to the inside of the hemispherical crown portion adjacent the base thereof forms a sweat band to engage the head of the user. The band also allows the cap to stretch circumferentially with at least that portion of the hemispherical crown portion covering the back of the head so as to enable the cap to self-adjust automatically to fit a plurality of head sizes. Thus, the stretchable band serves not only as a sweat band for the head, but stretches only circumferentially to allow the cap to automatically adjust to various sizes.

Thus, the present invention relates to a custom-fit cap comprising a visor portion, a substantially hemispherical crown portion having a base and being attached to the visor portion, the hemispherical crown portion covering the head of a user, a plurality of substantially triangular panels attached to each other to form the hemispherical crown portion, at least those panels covering the back of the head opposite the visor being formed of a material that stretches at least circumferentially about the crown portion for accommodating various head sizes, and a band stretchable only circumferentially and attached to the inside of the hemispherical crown portion adjacent to the base thereof, the stretchable band forming a sweat band to engage the head of the user and to stretch only circumferentially with at least that portion of the hemispherical crown portion covering the back of the head opposite the visor so as to enable the cap to self-adjust automatically to fit a plurality of head sizes.

All of the substantially triangular panels are all formed of a material that stretches substantially at least circumferentially. The material may be, for example only, wool/lycra.

The stretchable material forming the substantially triangular panels stretches only in the circumferential direction about said crown portion.

BRIEF DESCRIPTION OF THE DRAWINGS

These and other objects of the present invention will be more fully disclosed when taken in conjunction of the following DETAILED DESCRIPTION OF THE DRAWINGS in which like numerals will represent like elements and in which.

DETAILED DESCRIPTION OF THE DRAWINGS

Figure 1:
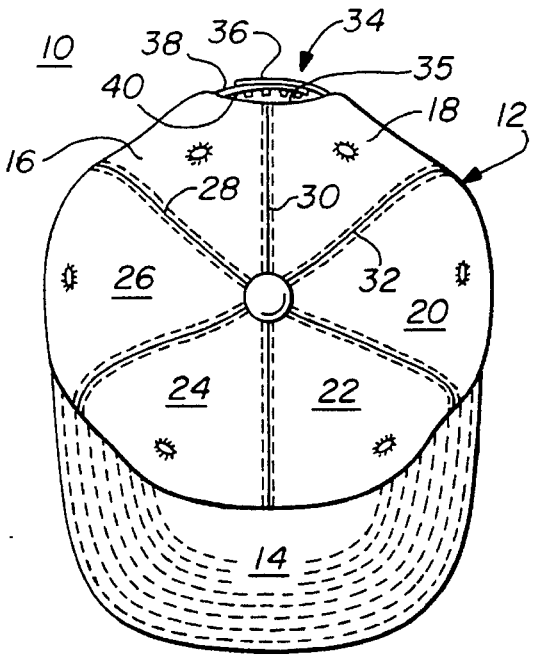
FIG. 1 is a top view of a prior art adjustable size cap.

FIG. 1 is a top view of a prior art cap 10, such as a baseball cap, having a hemispherical portion 12 and visor portion 14.

The hemispherical portion 12 is, of course, designed to fit the head of the user and is generally formed of a plurality of substantially regular panels 16, 18, 20, 22, 24, and 26 that are joined to each other by seams 28, 30, and 32. To make the cap 10 adjustable so as to fit various size heads, it has an adjustable portion 34 that includes an opening 35 in the back of the hemispherical portion 12, opposite the visor 14 and a strap 36 that extends from the substantially triangular panel 18 with projections 40 extending from it and strap 38 extends from substantially triangular panel 16 and has corresponding orifices in it. By adjusting the overlap of straps 36 and 38, and placing the projections 40 on strap 36 in various ones of the orifices in strap 38, the bottom periphery of the hemispherical portion 12 can be adjusted in size to fit various size heads.

Such cap 10 has the overlapping straps formed generally of plastic and then attached to the respective substantially triangular panels 16 and 18. The orifice or opening 35 must be cut in the proper areas of the triangular portion 16 and 18 and then mated together along seam 30 for proper construction thereof.

The present invention provides a custom-fit cap that fits a plurality of sizes and does not require overlapping straps 36 and 38 in the back as illustrated in FIG. 1.

Figure 2:
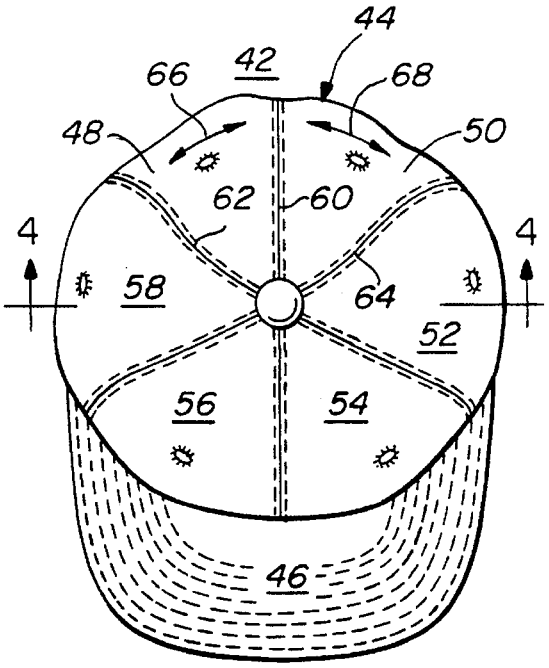
FIG. 2 is a top view of the cap of the present invention.

As shown in FIG. 2, the novel custom-fit cap 42 again has a substantial hemispherical portion 44 and a visor portion 46 attached thereto at the base of the hemispherical portion 44. Again, the hemispherical portion 44 is formed of a plurality of generally triangular panels 48, 50, 52, 54, 56, and 58 which are sewn to each other along seams 60, 62, and 64.

Preferably all of the substantially triangular panels 48, 50, 52, 54, 56, and 58, but at least panels 48 and 50 that cover the back of the head opposite the visor are formed of a material that stretches at least circumferentially about the crown portion as shown by arrows 66 and 68 to enable the cap to accommodate various head sizes. The material is preferably wool/LYCRA combination (e.g., a wool material combined with an elastic material) that is cut so as to form the substantially triangular panels 48–58 so that in the preferred embodiment they stretch only in the directions indicated by the arrows 66 and 68.

Figure 3:
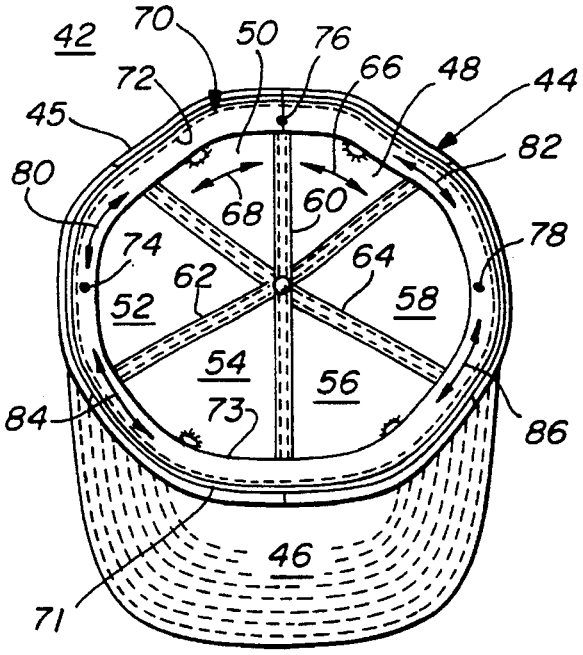
FIG. 3 is a bottom view of the novel cap of the present invention.

A bottom view of the novel custom-fit cap is illustrated in FIG. 3. In FIG. 3, the view is looking up inside of the substantially hemispherical crown portion 44. The substantially triangular panels 48, 50, 52, 54, 56, and 58 are again shown attached together with seams 60, 62, and 64. A stretchable band 70 is attached to the inside of the hemispherical crown portion 44, adjacent the base of 45 thereof. The stretchable band 70 forms a sweat band to engage the head of the user and allow the cap 42 to stretch circumferentially only as indicated by the arrows 80, 82, 84, and 86. The stretchable band 70 is an elongated rectangular band, having one elongated edge 71 attached to the inside of the hemispherical portion 44, substantially coextensive with the base portion 45 thereof by means such as a seam 72 which attaches the stretchable band to the hemispherical portion 44. The opposite elongated edge 73 of the stretchable band 70 extends up into the interior of the hemispherical portion 44 of the novel custom-fit cap 42 and is attached to the hemispherical portion 44 at additional attachment points, such as 74, 76, and 78, located between the one elongated edge 71 and opposite the elongated edge 73 of the stretchable band 70, at the back of the hemispherical portion of 44 shown by attachment point 76 opposite the visor and on each side of the hemispherical portion of the cap with respect to the visor 46, such as at points 74 and 78.

Figure 4:
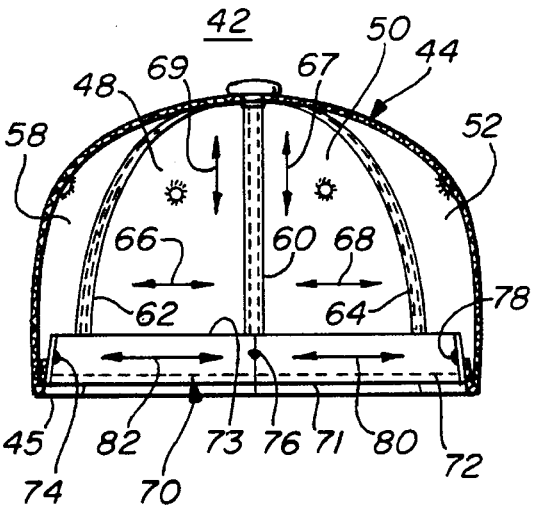
FIG. 4 is cross-sectional view of the novel hat shown in FIG. 2 taken along lines 4—4.

FIG. 4 illustrates a cross-sectional view of the novel cap taken along lines 4—4 of FIG. 2 and looking to the rear of the cap. Again, the novel band 70 can be seen with its lower edge 71 and its upper edge 73. The seam 72 which attaches the stretchable band 70 to the hemispherical portion 44 near the base 71 thereof can be seen.

As stated earlier, the stretchable material of the panels 48, 50, 52, 54, 56, and 58, preferably and at least 48 and 50 is formed of a stretchable material such as wool/LYCRA (i.e., an elastic material) cut such that it will stretch only circumferentially as indicated by arrows 66 and 68 and will not stretch in a direction perpendicular thereto as indicated by arrows 67 and 69 in FIG. 4. Further, the stretchable band 70 is also formed of a material that will stretch in the direction of arrows 80 and 82 shown in FIG. 4 but will not stretch in a direction perpendicular thereto. This allows the novel custom-fit cap to adjust itself to a plurality of different sizes to accommodate different individuals. At the same time, the cap is simple and economical to construct since it does not have the vent 35 in the back thereof as shown in FIG. 1, nor does it have the overlapping adjusting straps 36 and 38 as shown in FIG. 1. Yet, the novel cap 42 allows a custom fit for a plurality of different head sizes and is therefore a very desirable cap that is needed in the art.

Figure 5:
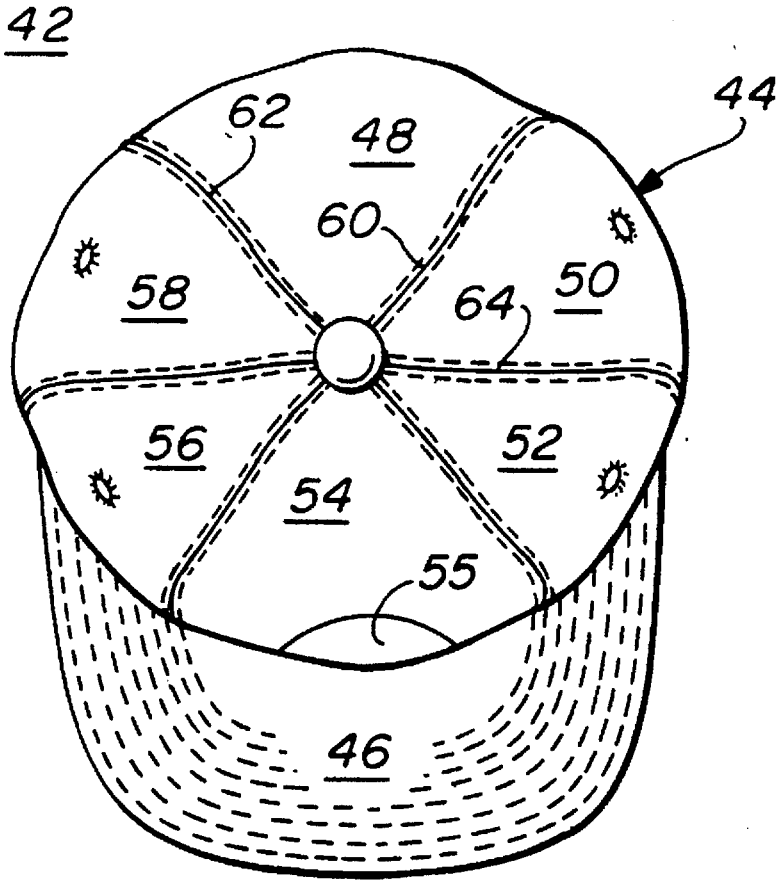
FIG. 5 is a top view of the novel hat with a front triangular panel centered with respect to the visor thereof.

Preferably, the present invention is advantageously used to form a cap as shown in FIG. 5 that is of the type disclosed in commonly assigned copending U.S. patent application Ser. No. 07/975,273 filed Nov. 12, 1992 and entitled "Visored Cap With Forward Facing Front Panel" and which application is incorporated herein by reference in its entirety.

FIG. 5 is a top view of such visored cap that includes a substantially triangular shaped panel 54 that faces forward and is centered with respect to the visor 46 so that a logo 55 can be placed on panel 54 facing forward and centered with respect to the visor 46. Because the panel 54 is a single-thickness panel of flexible material, it is easy to sew the logo 55 thereon. It will be noticed in FIG. 5 that the seam 60 is 30° to the left of the center of the visor 46 while seam 62 is 30° to the right of the center of the visor 46. The seam 64 runs from the bottom center of one side of the crown portion 44 to the bottom center of the other side of the crown portion 44. Thus there are six substantially equal size triangular panels 48, 50, 52, 54, 56, and 58 with panel 54 facing forward and being substantially centered with respect to the visor 46. Again, the cap 42 is a custom-fit cap that fits a plurality of sizes and does not require overlapping straps in the back to adjust the size thereof.

Thus, there has been disclosed a novel custom-fit cap that is formed with a crown portion for covering the back of the head and a visor portion, at least a portion of the crown portion being formed of a material that stretches only circumferentially about the crown portion for accommodating various head sizes. It includes a stretchable band that is stretchable only circumferentially and is attached to the inside of the hemispherical crown adjacent the base thereof. The stretchable band forms a sweat band to engage the head of the user and allow the cap to stretch circumferentially with at least a portion of the crown portion covering the back of the head opposite the visor, so as to enable the cap to self-adjust automatically to fit a plurality of head sizes. In one embodiment, the cap includes a crown formed of six substantially equal size triangular panels attached to a visor with one of the panels facing forward and being substantially centered with respect to the visor.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A custom-fit cap comprising:

a substantially hemispherical crown portion having a base portion attached to a visor portion, the hemispherical crown portion adapted for covering a head of a user;

at least that portion of the crown portion opposite the visor portion adapted for covering the back of the head being formed of a material that stretches at least circumferentially about the crown portion for accommodating various head sizes; and a single band stretchable only circumferentially and attached to the inside of the hemispherical crown portion adjacent the base thereof, the stretchable band forming a sweat band to engage a head of a user and allowing the cap to stretch circumferentially with at least that portion of the crown portion covering the back of the head opposite the visor portion so as to enable the cap to self-adjust automatically to a plurality of head sizes, wherein the band is (1) an elongated, circumferential band having one elongated edge attached to the inside of the crown portion substantially coextensive with the entire base portion thereof and an opposite elongated edge extending up into the interior of the crown portion and (2) attached to the crown portion at isolated attachment points between the elongated one edge and the opposite elongated edge of the stretchable band to substantially maintain the band in the interior of the crown portion while still allowing the cap to automatically self-adjust.

2. A custom-fit cap as in claim 1 wherein:

the substantially hemispherical crown portion is formed of a plurality of substantially triangular panels attached to each other; and at least those triangular panels opposite the visor portion to cover the back of the head are formed of the material that stretches at least circumferentially about the crown portion for accommodating various head sizes.

3. A custom-fit cap as in claim 2 wherein all of the substantially triangular panels are formed of a material that stretches substantially only circumferentially.

4. A custom fit cap as in claim 2 further comprising:

substantially equal size triangular panels forming said crown portion; and one of said triangular panels being substantially centered with respect to the visor portion when the crown portion is attached to the visor portion.

5. A custom-fit cap as in claim 1 wherein the stretchable material forming the crown portion opposite the visor portion and covering the back of a head stretches only in the circumferential direction about said crown portion.

6. A custom fit cap as in claim 1 wherein the band forming the sweat band is an elongated rectangular band.

7. A method of forming a custom-fit cap comprising:

forming a substantially hemispherical crown portion, the hemispherical crown portion having a base;

attaching a visor to the base of the substantially hemispherical crown portion;

forming at least that portion of the crown portion opposite the visor for covering the back of the head of a material that stretches at least circumferentially about the crown portion for accommodating various head sizes; and attaching a stretchable single band stretching circumferentially inside the hemispherical crown portion adjacent the base thereof to form a sweat band that engages a head of a user and allows the cap to stretch circumferentially by means of at least that portion of the crown portion covering the back of the head opposite the visor so as to enable the cap to self-adjust automatically to fit a plurality of head sizes, wherein the band is (1) an elongated, circumferential band having one elongated edge attached to the inside of the crown portion substantially coextensive with the entire base portion thereof and an opposite elongated edge extending up into the interior of the crown portion and (2) attached to the crown portion at isolated attachment points between the elongated one edge and the opposite elongated edge of the stretchable band to substantially maintain the band in the interior of the crown portion while still allowing the cap to automatically self-adjust.

8. A method as in claim 7, further comprising the steps of:

forming the substantially hemispherical crown portion of a plurality of substantially triangular panels attached to each other; and forming at least those triangular panels opposite the visor portion to cover the back of the head of a material that stretches at least circumferentially about the crown portion for accommodating various head sizes.

9. A method as in claim 8 further comprising the steps of:

forming the substantially triangular panels of substantially equal size; and centering one of the substantially triangular panels with respect to the visor portion when the crown portion is attached to the visor portion.

10. A custom-fit cap as in claim 7 including three isolated attachments spots.

11. A custom-fit cap as in claim 10 wherein the attachments spots are located at the back of the crown portion and on opposing sides of the crown portion.

12. A method as in claim 7 including three isolated attachments spots.

13. A method as in claim 12 wherein the attachments spots are located at the back of the crown portion and on opposing sides of the crown portion.

14. A custom-fit cap comprising:

a substantially hemispherical crown portion having a base portion attached to a visor portion, the hemispherical crown portion adapted for covering a head of a user; and a single band stretchable only circumferentially and attached to the inside of the hemispherical crown portion adjacent the base thereof, the stretchable band forming a sweat band to engage a head of a user and allowing the cap to stretch circumferentially with at least that portion of the crown portion covering the back of the head opposite the visor portion so as to enable the cap to self-adjust automatically to a plurality of head sizes, wherein the band is (1) an elongated, circumferential band having one elongated edge attached to the inside of the crown portion substantially coextensive with the entire base portion thereof and an opposite elongated edge extending up into the interior of the crown portion and (2) attached to the crown portion at isolated attachment points between the elongated one edge and the opposite elongated edge of the stretchable band to substantially maintain the band in the interior of the crown portion while still allowing the cap to automatically self-adjust.

15. A custom-fit cap as in claim 14 wherein:

the substantially hemispherical crown portion is formed of a plurality of substantially triangular panels attached to each other; and at least those triangular panels opposite the visor portion to cover the back of the head are formed of a material that stretches at least circumferentially about the crown portion for accommodating various head sizes.

16. A custom-fit cap as in claim 15 wherein all of the substantially triangular panels are formed of a material that stretches substantially only circumferentially.

17. A custom fit cap as in claim 15 further comprising:

substantially equal size triangular panels forming said crown port ion; and one of said triangular panels being substantially centered with respect to the visor portion when the crown portion is attached to the visor portion.

18. A custom-fit cap as in claim 15 wherein the band forming the stretchable material is a combination of wool and an elastic material.

19. A custom-fit cap as in claim 14 wherein the crown portion opposite the visor portion and covering the back of the head stretches in the circumferential direction about said crown portion.

20. A custom-fit cap as in claim 14 wherein the band forming the sweat band is an elongated rectangular band.

21. A custom-fit cap as in claim 14 including three isolated attachments spots.

22. A custom-fit cap as in claim 21 wherein the attachments spots are located at the back of the crown portion and on opposing sides of the crown portion.

23. A method of forming a custom-fit cap comprising:

forming a substantially hemispherical crown portion, the hemispherical crown portion having a base;

attaching a visor to the base of the substantially hemispherical crown portion; and attaching a stretchable single band stretching circumferentially inside the hemispherical crown portion adjacent the base thereof to form a sweat band that engages a head of a user and allows the cap to stretch circumferentially by means of at least that portion of the crown portion covering the back of the head opposite the visor so as to enable the cap to self-adjust automatically to fit a plurality of head sizes, wherein the band is (1) an elongated, circumferential band having one elongated edge attached to the inside of the crown portion substantially coextensive with the base portion thereof and an opposite elongated edge extending up into the interior of the crown portion and (2) attached to the crown portion at isolated attachment points between the elongated one edge and the opposite elongated edge of the stretchable band to substantially maintain the band in the interior of the crown portion while still allowing the cap to automatically self-adjust.

24. A method as in claim 23 further comprising the steps of:

forming the substantially hemispherical crown portion of a plurality of substantially triangular panels attached to each other; and forming at least those triangular panels opposite the visor portion to cover the back of the head of a material that stretches at least circumferentially about the crown portion for accommodating various head sizes.

25. A method as in claim 24 further comprising the steps of:

forming the substantially triangular panels of substantially equal size; and centering one of the substantially triangular panels with respect to the visor portion when the crown portion is attached to the visor portion.

26. A method as in claim 23 further comprising the steps of:

forming at least that portion of the crown portion opposite the visor portion for covering the back of the head of a material that stretches at least circumferentially about the crown portion for accommodating various head sizes.

27. A method as in claim 23 including three isolated attachments spots.

28. A method as in claim 27 wherein the attachments spots are located at the back of the crown portion and on opposing sides of the crown portion.

* * * * *